US006976559B2

(12) United States Patent
Iversen et al.

(10) Patent No.: US 6,976,559 B2
(45) Date of Patent: Dec. 20, 2005

(54) PISTON COMPRESSOR, PARTICULARLY HERMETICALLY ENCLOSED REFRIGERANT COMPRESSOR

(75) Inventors: Frank Holm Iversen, Padborg (DK); Preben Bjerre, Sønderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 432 days.

(21) Appl. No.: 09/977,409

(22) Filed: Oct. 15, 2001

(65) Prior Publication Data

US 2002/0050425 A1 May 2, 2002

(30) Foreign Application Priority Data

Oct. 28, 2000 (DE) ..... 100 53 575

(51) Int. Cl.[7] ..... F16C 9/04
(52) U.S. Cl. ..... 184/6.16; 74/605; 74/587; 384/294; 384/399
(58) Field of Search ..... 184/6.16–6.18; 74/587, 594, 605; 384/288, 294, 399, 430

(56) References Cited

U.S. PATENT DOCUMENTS 3,781,135 A * 12/1973 Nickell ..... 417/295
4,236,874 A * 12/1980 Sisk ..... 417/315
4,518,323 A * 5/1985 Elson et al. ..... 417/312
4,567,815 A * 2/1986 Kocher ..... 92/261
4,856,366 A * 8/1989 Nikolaus ..... 74/605
5,039,285 A * 8/1991 Lindstrom ..... 417/368
5,093,285 A 3/1992 Murkens ..... 501/17
5,842,420 A 12/1998 Khoo et al. ..... 184/6.16
6,024,548 A * 2/2000 Bushnell ..... 418/94

FOREIGN PATENT DOCUMENTS

DE 195 16 811 C2 11/1996 ..... H02K 3/38

* cited by examiner

*Primary Examiner*—Chong H. Kim
(74) *Attorney, Agent, or Firm*—McCormick Paulding & Huber LLP

(57) ABSTRACT

The invention relates to a piston compressor, particularly a hermetically enclosed refrigerant compressor, with a crank drive, having a crank shaft with an eccentric crank pin and an oil channel arrangement, and a connecting rod with a first piston-side connecting rod eye and a second pin-side connecting rod eye, said eyes having between them a connecting rod shank with a longitudinal channel, which opens into the connecting rod eyes.

In this compressor, it is endeavoured to improve the lubricating conditions.

For this purpose a bearing element is arranged between the crank pin and the second connecting rod eye, which is unrotatably connected with the second connecting rod eye under formation of an oil channel, the longitudinal channel communicating with the oil channel and a control arrangement being provided, which ensures a communication between the oil channel and the oil channel arrangement at least once per rotation of the crank pin.

10 Claims, 4 Drawing Sheets

PISTON COMPRESSOR, PARTICULARLY HERMETICALLY ENCLOSED REFRIGERANT COMPRESSOR

FIELD OF THE INVENTION

The invention relates to a piston compressor, particularly a hermetically enclosed refrigerant compressor, with a crank drive having a crank shaft with an eccentric crank pin and an oil channel arrangement, and a connecting rod with a piston-side first connecting rod eye and a pin-side second connecting rod eye, said eyes having between them a connecting rod shank with a longitudinal channel, which opens into the connecting rod eyes.

BACKGROUND OF THE INVENTION

A piston compressor of this kind is known from U.S. Pat. No. 5,842,420. The crank shaft is driven by an electric motor. In this connection, the crank pin orbits around the axis of the crank shaft. By means of the connecting rod, this orbiting movement is transferred to a piston, which then reciprocates straightly in a cylinder. The lower end of the crank shaft is submerged in an oil sump. Through the rotation of the crank shaft and the resulting centrifugal forces in the oil channel arrangement, the oil from the oil sump can be conveyed to the crank pin. From here the oil leaves through an opening of the oil channel arrangement in the circumferential surface of the crank pin with the main purpose of lubricating the bearing surface between the crank pin and the second connecting rod eye. On each rotation, the opening once comes to overlap the longitudinal channel, so that a short oil supply or pulse also reaches the first connecting rod eye with the purpose of lubricating the bearing surface between the first connecting rod eye and a bearing pin arranged in the piston.

A similar embodiment is known from U.S. Pat. No. 5,093,285. Further to the longitudinal channel in the connecting rod shank, additional channels are provided in the connecting rod, which channels end on the outside of the connecting rod and are directed into a piston chamber, in which the piston pin is arranged.

Another kind of lubrication is shown in DE 195 16 811 C2. Here, a sleeve is arranged between the second connecting rod eye and the crank pin, which sleeve projects in the axial direction from the crank pin and forms a reservoir, into which the oil channel arrangement opens. From the reservoir the oil can flow downwards to lubricate a bearing surface between the sleeve and the crank pin. This document says nothing about a lubrication in the area of the first connecting rod eye.

In the known compressors, whose connecting rods have a longitudinal channel, there is a problem in that the lubricating layer between the second connecting rod eye and the crank pin is weakened particularly in the areas, in which a relatively large load must be adopted. This is caused by the fact that the place where the oil is supplied cannot be chosen at will. During operation the oil is transported by the centrifugal force, which requires that the outlet of the oil channel arrangement is radially offset in relation to the centrically arranged suction position. When the radial offset is too small, the pumping effect is too weak. This then causes that the outlet of the oil channel arrangement practically always overlaps the longitudinal channel of the connecting rod shank, when the piston is close to or in the upper dead centre. However, at this instant, the load is the largest.

SUMMARY OF THE INVENTION

The invention is based on the task of improving the lubricating conditions.

In a piston compressor of the kind mentioned in the introduction, this task is solved in that between the crank pin and the second connecting rod eye a bearing element is arranged, which is unrotatably connected with the second connecting rod eye under formation of an oil channel, the longitudinal channel communicating with the oil channel and a control arrangement being provided, which ensures a communication between the oil channel and the oil channel arrangement at least once per rotation of the crank pin.

This piston compressor gives a larger freedom when selecting the time, at which the longitudinal channel is supplied with oil. Thus, the supply to the piston via the longitudinal channel and the consequent supply to the bearing area between the first connecting rod eye and a bolt in the piston can be delayed to a time, at which the load is smaller. Additionally, the communication between the oil channel arrangement and the oil channel can be made in such a way that a weakening of the lubricating layer between the bearing element and the crank pin takes place in an area, which is less loaded. This improves the lubrication conditions in the area of the bearing between the crank pin and the bearing element. When the lubrication can be improved by means of constructional measures, a low viscosity oil can be used, that is, a highly fluid oil, which causes less friction and a lower resistance against a movement between the piston and the cylinder. This again leads to an improved efficiency.

Preferably, the control arrangement comprises at least one radial bore in the bearing element, which bore overlaps an oil source on a rotation of the crank pin. Thus, the radial bore forms a control opening, which permits a specific selection of the moment, at which the longitudinal channel can be supplied with oil via the oil channel between the second connecting rod eye and the bearing element. Thus, it is avoided that the opening of the longitudinal channel immediately overlaps the oil source, which could cause a weakening of the lubricating layer because of the consequent pressure drop.

Preferably, the oil source is formed by an opening of the oil channel arrangement into the circumferential wall of the crank pin. Thus, the conveying effect of the oil channel arrangement in connection with a rotation of the crankshaft is utilised, as known per se. Additionally, this arrangement ensures that also the contact area between the bearing element and the crank pin is sufficiently lubricated. Oil leaving the opening penetrates between the bearing element and the crank pin. Merely in the area of the radial bore the lubricating layer is weakened. As, however, the area of this weakening can be located in a place, where the load of the bearing between the bearing element and the crank pin is relatively low, this weakening can be accepted.

Preferably, in the area of the opening the crank pin has an oil pocket. Firstly, this oil pocket ensures a better spread of the oil in the contact area between the bearing element and the crank pin, and secondly it ensures an improved pumping effect, when the radial bore overlaps the oil pocket.

Preferably, the radial bore is offset in the circumferential direction in relation to the opening of the longitudinal channel into the oil channel. The size of the offset is decisive for the moment, at which the longitudinal channel receives the oil pulse. By selecting the offset, it is thus possible within relatively large limits to determine the moment, at which the lubricating oil is again pressed into the longitudinal channel with the purpose of supplying also the other connecting rod eye and a lubrication groove in the piston.

In this connection, it is particularly preferred that the first connecting rod eye surrounds a piston bolt, which has a lubrication channel, said channel overlapping the longitudinal channel at least once during a rotation of the crank pin, the control arrangement establishing the communication at that time. Thus, lubrication oil is not merely supplied to the contact area between the first connecting rod eye and the piston bolt, to reduce the friction here. The oil can also be transported through the piston bolt. For this purpose the lubrication channel is provided. The oil pressed through the lubrication channel then reaches an annular channel that surrounds the piston. This causes an improved sealing of the piston in the cylinder of the compressor.

Preferably, the control arrangement establishes the communication during a suction phase of the compressor. During the suction phase the bearing created by means of the first connecting rod eye and the piston bolt is less loaded than during a compression phase. The oil pressed through the longitudinal channel therefore spreads better in the gap between the first connecting rod eye and the piston bolt, so that the lubrication conditions remain good.

Preferably, the control arrangement establishes the communication a second time at the beginning of a compression phase of the compressor. Thus, an additional oil supply is ensured exactly during the phase, in which the bearing at the first connecting rod eye is most loaded. Additionally, oil is pressed into the lubrication channel and then reaches the annular channel surrounding the piston, so that a good sealing and lubrication is ensured between the piston and the cylinder during the subsequent compression process, which prevents or at least dramatically reduces a leakage of the compressed refrigerant.

Preferably, the bearing element has two radial bores, which are arranged at a predetermined distance in relation to each other and to the opening of the longitudinal channel. Thus, the two times, at which the control arrangement establishes the communication between the oil channel and the oil channel arrangement, can be determined very accurately.

Preferably, the bearing element and the second connecting rod eye are provided with mutually adapted markings. This ensures that during mounting, the connecting rod eye and the bearing element are joined with the correct orientation.

It is also preferred that the bearing element has at least the same strength as the second connecting rod eye. This strength can be reached in that either the wall thickness of the bearing element is chosen to be accordingly high, or in that a correspondingly strong material is used. Of course, these two measures can also be combined. Thus, the bearing element has an improved natural stability. After being pressed into the connecting rod eye, thin-walled or weakly designed sleeves tend to assume a conical shape, which expands towards the axial ends of the connecting rod eye. This causes that over large areas of the bearing the lubricating layer is weakened. When, however, the bearing element is made to have sufficient natural stability, it will maintain its cylindrical shape also after being pressed into the second connecting rod eye, so that a stable oil layer, capable of bearing, is achieved on practically the whole bearing surface. This leads to improved wear properties of the bearing.

Preferably, in the circumferential direction the oil channel is limited to a predetermined section. This means that the oil channel does not have to extend completely in the circumferential direction. It is sufficient, when it establishes a communication between the radial bore and the longitudinal channel. This simplifies the manufacturing.

BRIEF DESCRIPTION OF THE DRAWINGS

In the following the invention is described in detail on the basis of a preferred embodiment in connection with the drawings, wherein.

DETAILED DESCRIPTION OF THE PREFERRED EMBODIMENT

Figure 1:
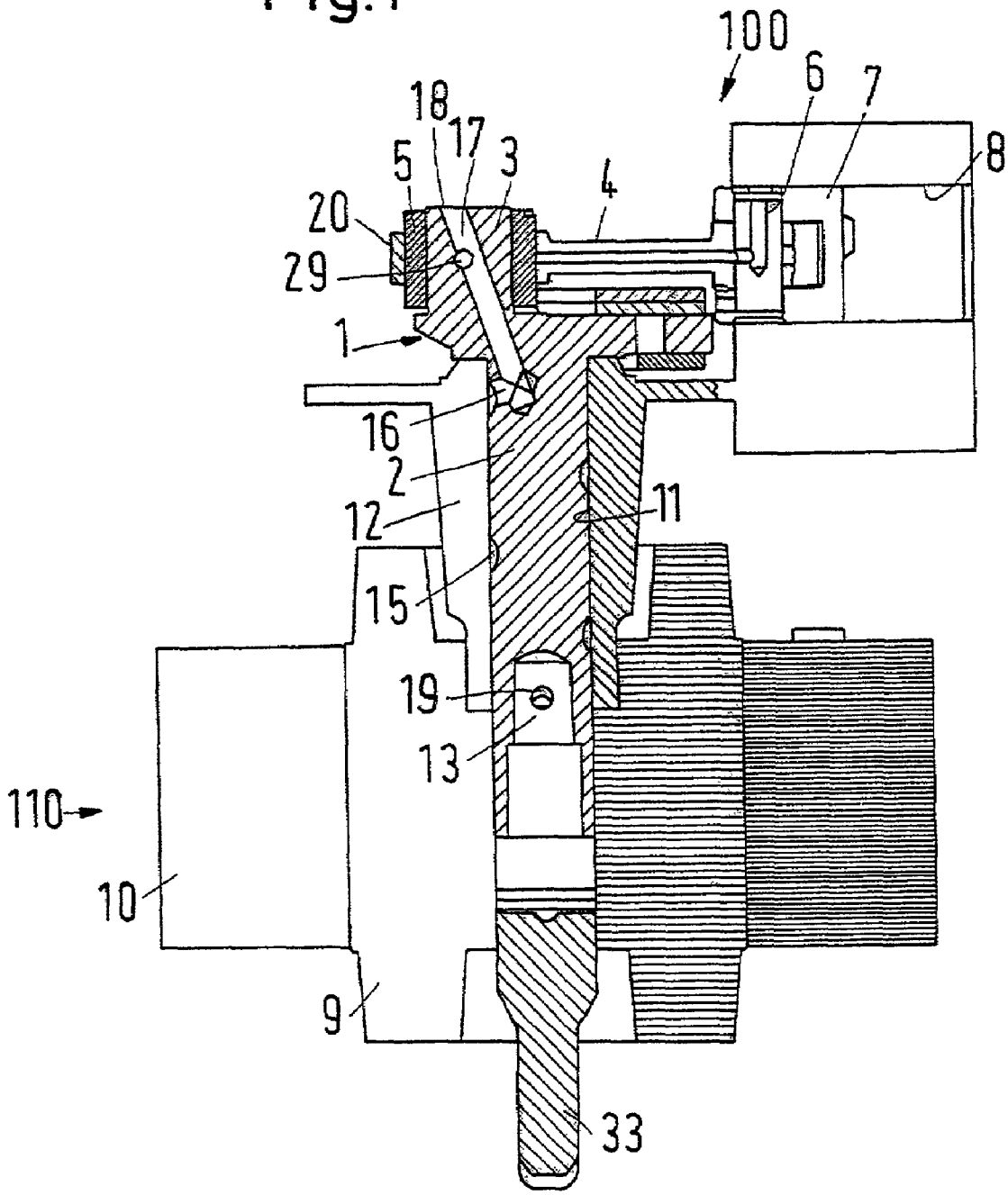
FIG. 1 is a schematic side view of a piston compressor
Figure 2:
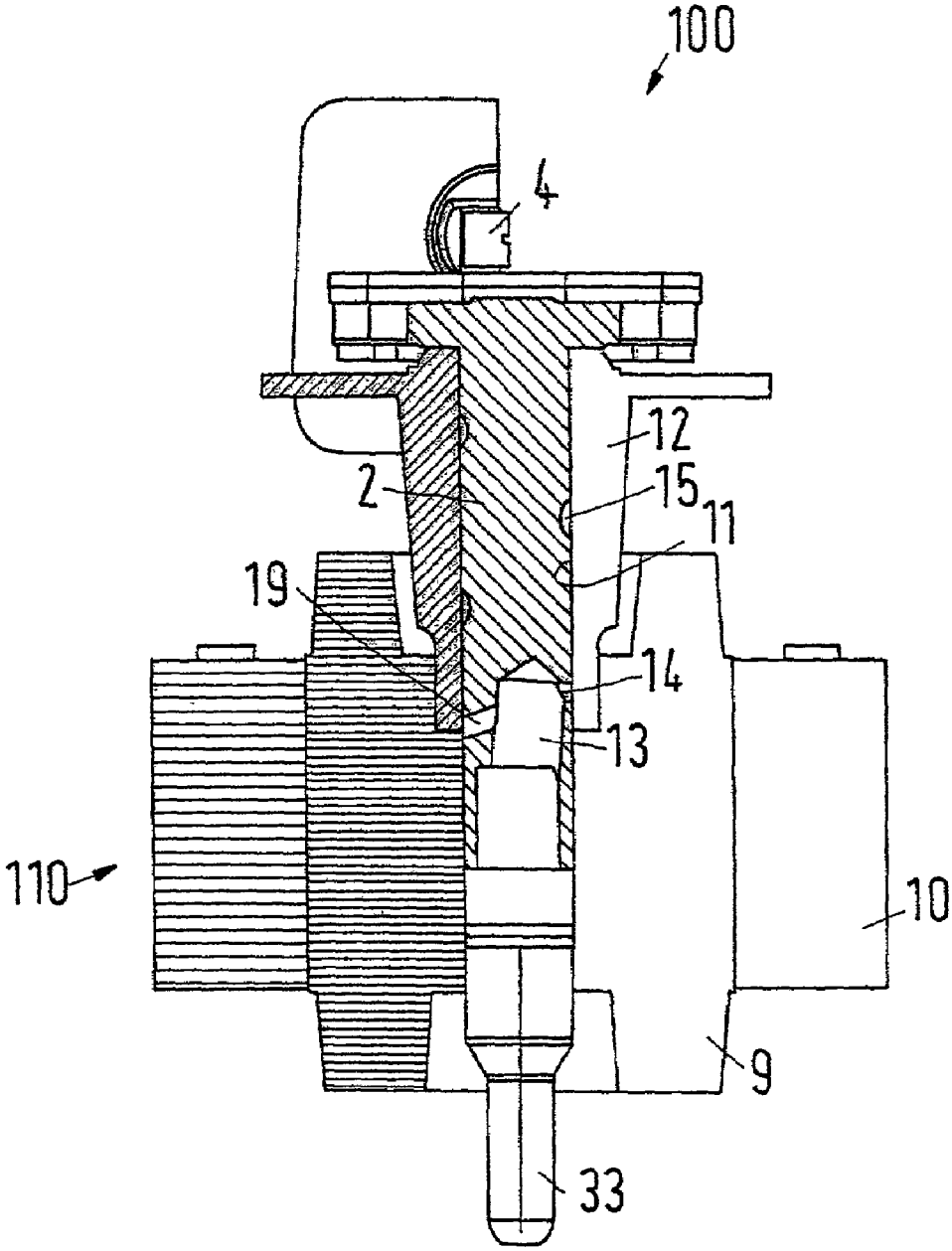
FIG. 2 is a schematic front view of a piston compressor

FIGS. 1 and 2 show a piston compressor generally designated by the reference number 100 with a piston 7 arranged in a cylinder 8. For the compression of a refrigerant, the refrigerant is sucked into the cylinder via a valve arrangement, which is not shown in detail, when the piston in FIG. 1 moves to the left. The refrigerant is compressed, when the piston 7 in FIG. 1 moves to the right. The piston is driven by an electric motor 110, which has a stator 10, in which a rotor 9 is rotatably supported. The conversion of the rotary motion of the rotor 9 into the translatory motion of the piston 7 takes place by means of crank drive 1. The crank drive 1 has a crankshaft 2, at one end of which a crank pin 3 is formed. In the embodiment shown, the crank pin 3 is arranged at the upper end of the crankshaft 2. However, it is possible to switch the arrangement of motor 110 and cylinder 8 in relation to the crankshaft 2. In this case, the crank pin 3 will be arranged at the lower end of the crankshaft 2.

A connecting rod 4 establishes communication between the crank pin 3 and the piston 7. For this purpose, the piston 7 is provided with a piston bolt 6, which is surrounded by a first connecting rod eye 21 (FIG. 3) of the connecting rod 4. Between the crank pin 3 and a second connecting rod eye 20 at the other end of the connecting rod 4, a bearing element 5 is arranged, which, in the present case, has the form of a bearing sleeve and is unrotatably connected with the second connecting rod eye 20.

The crankshaft 2 is supported in a main bearing 11, which is formed in a compressor block 12. Below the crankshaft 2 is arranged an oil pump 33 for the supply of lubricating oil from an oil sump (not shown), the oil pump also being fixedly connected with the rotor 9. The oil pump 33 transports the oil from the oil sump, in a manner known per se, by means of centrifugal forces.

During the rotation of the crankshaft 2, the oil transported by the oil pump 33 reaches a blind hole 13 at the lower end of the crankshaft 2. The axis of the blind hole 13 is slightly inclined in relation to the axis of the crankshaft 2, which is particularly obvious from FIG. 2. Therefore, on rotation of the crankshaft 2, the oil sucked in is pressed radially outward by the centrifugal force, and flows upward along the outer wall of the blind hole until reaching a radial bore 14 which connects the blind hole 13 with a helical groove 15. The helical groove 15 extends along the outer surface of the crankshaft 2 in the area of the main bearing 11. Via a second radial bore 16 in the crankshaft 2, which is made below the crank pin 3, and is in communication with the groove 15, the transported oil is returned to the inside of the shaft 2, before it penetrates the crank pin 3 through a channel 17, which is also inclined in relation to the axis of the crankshaft 2, and reaches the upper front side of the crank pin 3. Here, the oil can flow out through an opening 18 in the channel 17. The total path described, through which the oil flows during operation is referred to herein as the oil channel arrangement.

For venting the oil, a bore 19 leads out of the blind hole 13 of the crankshaft 2. Preferably, the bore 19 is made together with the bore 14 and opens to the outside of the crankshaft 2 at the level of a gap between the rotor 9 and the compressor block 12. Through the bore 19, gaseous refrigerant can escape from the oil.

Figure 3:
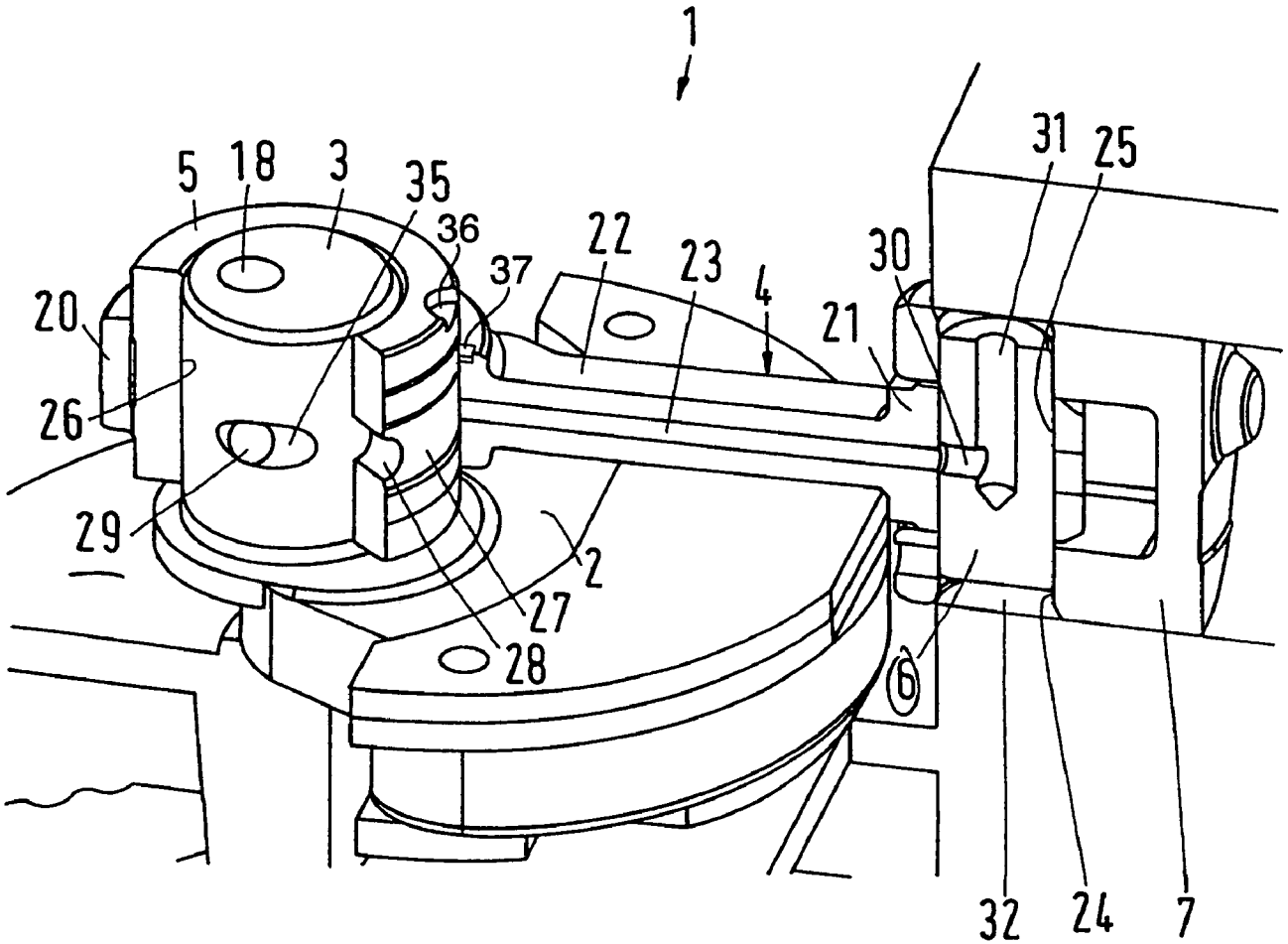
FIG. 3 is a perspective view of a crank drive, partially in section

FIG. 3 shows an enlarged view of the crank drive 1 with the upper end of the crankshaft 2 and the crank pin 3. As already mentioned, the connecting rod 4 has a piston-side first connecting rod eye 21, which is occasionally also called small connecting rod eye, and a pin-side second connecting rod eye 20, which is also called large connecting rod eye, as its diameter is larger than that of the first connecting rod eye 21. The two connecting rod eyes 20, 21 are connected via a connecting rod shank 22, inside which a longitudinal channel extends. The piston 7 is rotatably connected with the connecting rod 4 via the piston bolt 6, which is pressed into a cross opening 24 of the piston and thus held unrotatably in relation to the piston 7. In other words, a bolt bearing 25 is formed in the first connecting rod eye 21.

The bearing sleeve 5 is pressed into the second connecting rod eye 20. Together with the crank pin 3, the inner face of the bearing element 5 forms a pin bearing 26. The connecting rod eye 20 and the bearing element 5 each define an alignment mark 36 and 37, respectively.

On the outer circumferential surface of the bearing element 5 there is arranged a circumferential oil channel 27, which communicates with the longitudinal channel 23 in the connecting rod shank 22. The oil channel 27 can also be formed in that the second connecting rod eye 20 has a corresponding circumferential groove on its inner wall. Of course, grooves on the outside of the bearing element 5 and the inside of the second connecting rod eye 20 can also be combined with each other to form the oil channel.

In the bearing sleeve 5 a radial bore 28 is formed to connect the oil channel 27 and the pin bearing 26. In relation to the opening of the longitudinal channel 23 into the oil channel 27 this radial bore 28 is offset in the circumferential direction by a predetermined angle. The oil channel does not have to extend over the whole circumference. It is sufficient, when the oil channel 27 creates a communication between the opening of the longitudinal channel 23 and the radial bore 28. This simplifies the manufacturing of the second connecting rod eye 20.

Additionally, an opening 29 of the oil channel arrangement is provided in the crank pin 3. This opening branches off from the channel 17. The opening 29 is surrounded by an oil pocket 35, which is formed in that the cylindrical wall of the crank pin 3 is simply eased off to a certain degree in the area of the opening 29. In the axial direction, the opening 29 is provided in approximately the same position as the radial bore 28, meaning that on one rotation of the crank pin 3 in the bearing element 5 will cause the radial bore 28 to overlap the opening 29 once. The opening 29 can also be called pressure source, as during operation oil is currently supplied to the pin bearing 26 from the inclined channel 17 via the oil channel arrangement.

When the radial bore 28 overlaps the opening 29, a connection is created between the channel 17, that is, the oil channel arrangement, and the oil channel 27. As the longitudinal channel 23 is connected with the oil channel 27, the overlapping of the radial bore 28 and the opening 29 will create a communication from the oil channel arrangement via the opening 29, the radial bore 28, the oil channel 27, the longitudinal channel 23 to the bolt bearing 25, and a certain amount of oil will be pressed into the connecting rod 4.

The bolt 6 has a radial bore 30, which is connected with an axial bore 31. The axial bore 31 communicates with a circumferential lubricating groove 32 on the piston 7. In the position shown in FIG. 3, in which the radial bore 30 is in alignment with the longitudinal channel 23, oil is supplied into the lubricating groove 32, when the opening 29 overlaps the radial bore 28. Normally, the communication between the longitudinal channel 23 and the bore 30 is always open.

The position of the radial bore 28 in relation to the opening 29 determines the mement of the oil pulse in the direction towards the piston. In the embodiment shown, this oil pulse is generated at the beginning of the suction phase, after that the piston has passed its upper dead centre. As, in this phase, the bolt bearing 25 is only exposed to a small load, the oil supplied can spread well between the piston bolt 6 and the piston 7.

Figure 4:
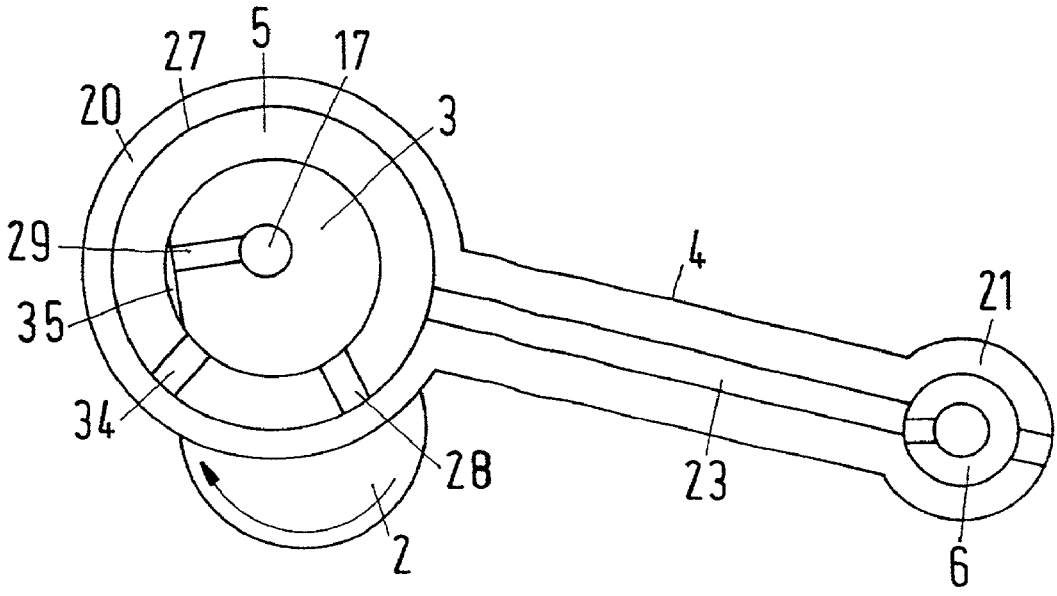
FIG. 4 is a horizontal cross section through crank pin, connecting rod, bearing sleeve and piston pin

FIG. 4 shows a horizontal section through the crank pin 3, the connecting rod 4, the bearing element 5 and the piston bolt 6 at a time during the compression phase of the piston. The rotation direction of the crankshaft 2 is shown by means of an arrow.

It can be seen that the bearing element 5 is provided with two radial bores 28, 34, the axes of the bores 28, 34 having a certain angle in relation to each other and to the opening of the longitudinal channel 23 into the oil channel 27. This makes it possible to press an oil pulse into the first connecting rod eye 21 twice during one rotation. The situation shown appears shortly after the beginning of the compression phase of the piston 7 in the cylinder 8, that is, shortly after the generation of a second oil pulse. At this instant, the piston bolt 6 is in the position shown in FIG. 3 in relation to the longitudinal channel 23, so that the oil pressed through the longitudinal channel 23 gets into the lubricating groove 32 of the piston, thus ensuring an improved tightness during the compression. The first oil pulse occurs, as mentioned above, during the suction phase, meaning that the oil pulse can definitely also be generated in the middle of the suction phase. In a manner of speaking, the crank drive 1 is thus provided with a control arrangement, which ensures that, at predetermined times, which can in principle be selected more or less at random through the arrangement of the radial bores 28, 34, an oil pulse for the supply of the bolt bearing 25 is generated. Thus, not only is the selection of the oil pulse free, but the pressure drop between the bearing element 5 and the crank pin 3 and the resulting weakening of the oil layer can be placed in less loaded areas.

What is claimed is:

1. A hermetically enclosed refrigerant compressor comprising:

a compressor block having a bore extending therethrough;

a crank shaft positioned for rotation in the bore, the crank shaft defining an eccentric crank pin at one end thereof;

the crank shaft and crank pin cooperating to define an oil channel arrangement;

a connecting rod attached at one end to a bearing element such that there is no relative motion between the bearing element and the connecting rod, the connecting rod having a passage extending therethrough and in communication with a channel formed by the cooperation of the connecting rod and the bearing element, the bearing element being formed as a single piece having a substantially cylindrical shape and the channel extending completely around a circumference of the bearing element;

the crank pin extending into the bearing element and being positioned for rotation relative thereto; and a control arrangement providing communication between the channel and the oil channel arrangement, at least once per revolution of the crank pin.

2. A compressor according to claim 1, wherein the control arrangement comprises at least one radial bore in the bearing element, which bore overlaps an oil source upon a rotation of the crank pin.

3. A compressor according to claim 2, wherein the oil source is formed by an opening in the crank pin and forming part of the oil channel arrangement.

4. A compressor according to claim 3, wherein the crank pin defines an oil pocket in a area proximate the opening forming part of the oil channel arrangement.

5. A compressor according to claim 2, wherein the passage defines an opening into the channel and the radial bore is offset in a circumferential direction relative to the opening.

6. A compressor according to claim 1, wherein the connecting rod includes a first connecting rod eye opposite the end attached to the bearing element, the connecting rod eye surrounding a piston bolt having a lubrication channel that overlaps the passage at least once during a revolution of the crank pin, the control arrangement establishing the communication between the passage and the channel.

7. A compressor according to claim 1, wherein the control arrangement establishes the communication during a suction phase of the compressor.

8. A compressor according to claim 1, wherein the control arrangement further establishes the communication when a compression phase of the compressor begins.

9. A compressor according to claim 8, wherein the bearing element defines two radial bores arranged at a predetermined distance relative to each other and to the opening of the passage.

10. A compressor according to claim 1, wherein the connecting rod defines a rod eye positioned over the bearing element, wherein at least one of the bearing element and the rod eye includes an alignment mark for aligning said bearing element with said rod eye.

* * * * *